US005910028A

United States Patent [19]

Tsuji

[11] Patent Number: 5,910,028

[45] Date of Patent: Jun. 8, 1999

[54] CONNECTOR

[75] Inventor: Takeshi Tsuji, Yokkaichi, Japan

[73] Assignee: Sumitomo Wiring Systems, Ltd., Japan

[21] Appl. No.: 08/990,426

[22] Filed: Dec. 15, 1997

[30] Foreign Application Priority Data

Dec. 13, 1996 [JP] Japan ..... 8-334131

[51] Int. Cl.[6] ..... H01R 3/00

[52] U.S. Cl. ..... 439/489; 439/354

[58] Field of Search ..... 439/350, 352–358, 439/488, 489

[56] References Cited

U.S. PATENT DOCUMENTS 5,169,329 12/1992 Taguchi .
5,330,369 7/1994 Nozaki et al. .
5,507,666 4/1996 Yamanashi .
5,672,073 9/1997 Matsumura et al. ..... 439/489
5,681,178 10/1997 Kunkle et al. ..... 439/352

FOREIGN PATENT DOCUMENTS 0655807 5/1995 European Pat. Off. .

*Primary Examiner*—Khiem Nguyen
*Attorney, Agent, or Firm*—Banner & Witcoff, Ltd.

[57] ABSTRACT

When male and female connector housings 1 and 11 are in a half-fitted state, a spacer insertion groove 24 located at a posterior end of a locking arm 20 does not fully open. In order to prevent forcible insertion of a spacer, the insertion ends 33 of a spacer 30 have an inclined lower face, to reduce or eliminate a force tending to push up the locking arm 20. Even in the case where the first insertion ends 33 are forcibly inserted into half-fitted connector housings 1 and 11, complete insertion is prevented because a second insertion member 38 of the spacer 30 and the position of a through hole 23 are not aligned. Half fitting is thus reliably detected.

14 Claims, 6 Drawing Sheets

CONNECTOR

TECHNICAL FIELD

The present invention relates to a connector, and in particular to a connector having provided therein a detecting means for detecting whether or not mating connectors are correctly fitted together.

BACKGROUND OF THE INVENTION

As shown in FIGS. 8 to 10 of this specification, a spacer 52 is commonly used as a means for detecting the fitted state of two connectors. When two connector housings 50 and 53 fit together correctly, a locking arm 51, that changes shape and bends as the fitting progresses, reverts to its unbent shape, and a protrusion 54 formed on the locking arm 51 fits into a lock receiving groove 55 formed on the corresponding connector housing 53, thereby locking the housings 50 and 53 together. An opening 56 is provided between the locking arm 51 and the facing face of the housing 50, the opening 56 allowing the insertion of the spacer 52.

In the case where the fitting of such a pair of connector housings 50 and 53 has not been correctly carried out and these are in a half-fitted state, as shown in FIG. 9, the entrance of the opening 56 towards the posterior of the locking arm 51 is not sufficiently wide. For this reason, the spacer 52 cannot be inserted easily, and this informs the operator that the connector housings 50 and 53 are in a half-fitted state.

An anteriorly tapering tapered face 52A is formed on the anterior end portion of the spacer 52, this tapered face 52A making it possible to smoothly carry out the initial insertion operation into the space 56 located below the locking arm 51. However, as shown in FIG. 9, in the case where the insertion of the spacer 52 is carried with the tapered face 52A upwards, a force F applies bending the locking arm 51 upwards. For this reason, in the case where the operation is carried out with the excessive force, even if a half-fitted state exists, as shown in FIG. 10, the anterior end of the locking arm 51 gets bent upwards, making the insertion of the spacer 52 possible. Allowing such a possibility results in a decrease in the reliability of detection of the half-fitted position, and an appropriate solution is desirable.

The present invention has been developed after taking the above problem into consideration, and aims to provide a connector having a higher reliability as regards detecting the half-fitted state.

SUMMARY OF THE INVENTION

According to the invention there is provided a connector having a housing, a cantilever locking arm on the housing and a space between the locking arm and the housing, the locking arm being bendable towards the housing to narrow said space during connection with a mating connector and resuming an unbent condition on full engagement of the connectors, and a spacer insertable in said space only in the unbent condition of said locking arm, the spacer being adapted to indicate half-fitting of the connectors, wherein the distal end of said spacer constitutes primary detecting means and is tapered on the side opposite to said locking arm. Such a spacer cannot be easily forced into the space underneath the locking arm and is thus a more reliable indicator of half fitting.

Preferably, in the bent condition a spacer engaging portion of said locking arm is inboard a spacer engaging portion of said housing.

This arrangement ensures that initial contact of the spacer is against the housing, and thus forcible entry into the space is less likely.

Secondary detecting means may be provided on the spacer and engageable with the locking arm only in the unbent condition. In the preferred embodiment a projection of the spacer is engageable in an aperture of the locking arm, preferably the aperture necessary to provide a latch protrusion of the locking arm by insert moulding.

The spacer may house two spaced limbs for engagement in said space, and retention means to hold the spacer in the fully inserted condition. The retention means may comprise resilient hooks to engage said locking arm.

BRIEF DESCRIPTION OF DRAWINGS

Other features of the invention will be apparent from the following description of a preferred embodiment, shown by way of example only in the accompanying drawings, in which.

DESCRIPTION OF PREFERRED EMBODIMENTS

Figure 1:
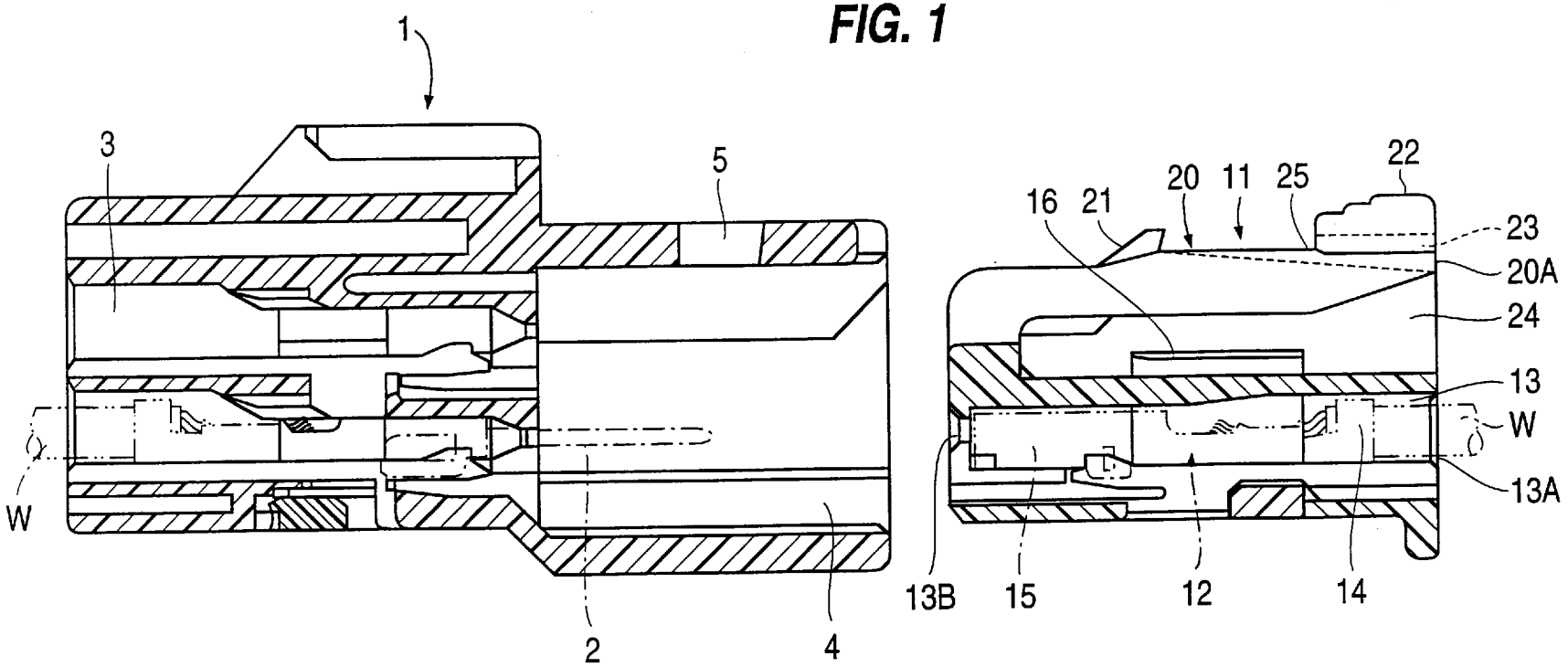
FIG. 1 is a side cross-sectional view showing the present embodiment in a state preceding the fitting together of a connector housing and a corresponding connector housing.
Figure 2:
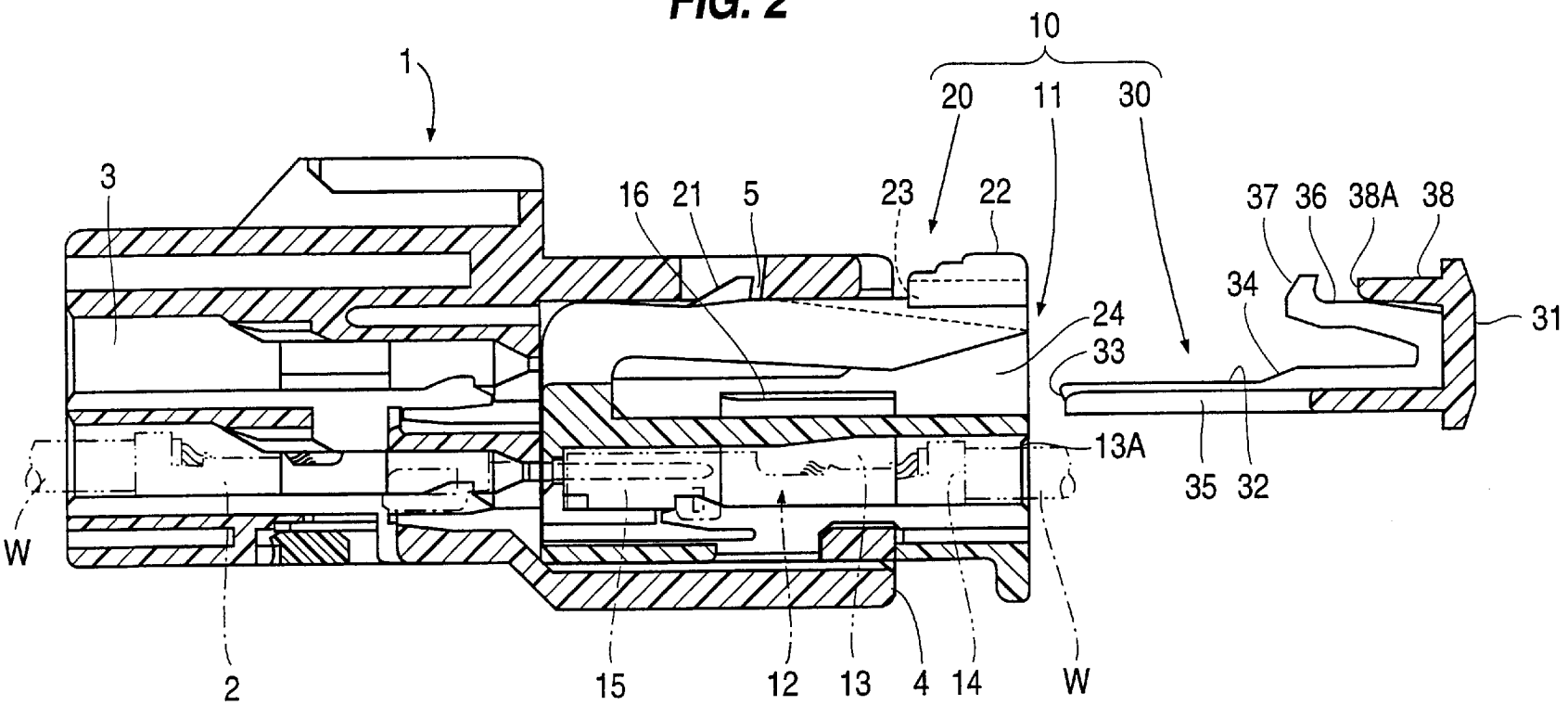
FIG. 2 is a side cross-sectional view showing a state where a spacer is inserted after the connector housing and the corresponding connector housing have reached the correct fitted state.
Figure 3:
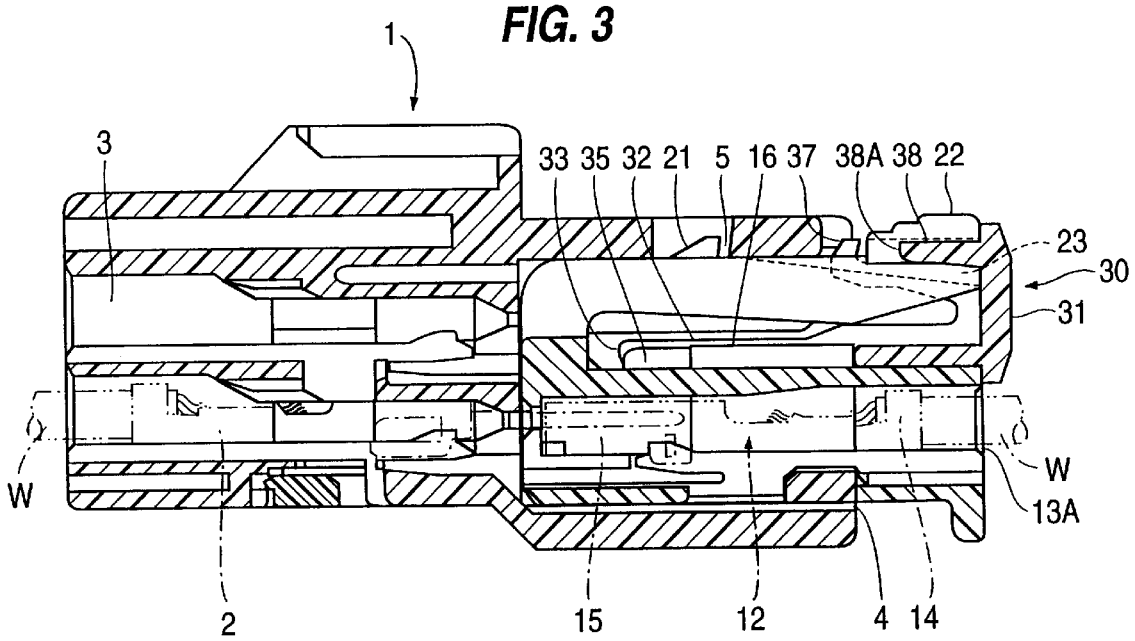
FIG. 3 is a side cross-sectional view showing the insertion of the spacer into the connector housing.
Figure 4:
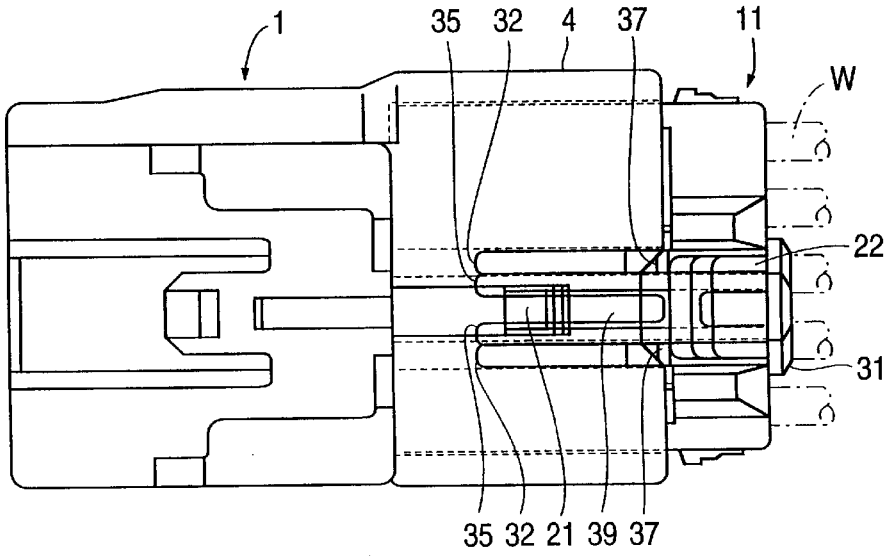
FIG. 4 is a plan view of FIG. 3.

A male connector housing 1 is formed of a synthetic resin in a unified manner, and its anterior portion has a hood member 4 formed thereon. The male connector housing 1 has terminal housing chambers 3 formed in rows at two levels. In the state where terminal fittings 2 are retained therein, their anterior ends protrude into the hood member 4.

The hood member 4 fits with a female terminal housing 11. When the male and female terminal housings 1 and 11 are fitted together, the male and female terminals are electrically connected. Moreover, the upper central face of the hood member 4 has a fitting groove 5 formed in a anterior-posterior direction, a portion of the posterior edge of the hood member 4 being left intact. A protrusion 21 of a locking arm 20 of a female connector 10 fits with this portion. Further, the posterior end of the upper face of the hood member 4 is cut out into a concave shape, thereby preventing contact with a claw 37 of a spacer 30.

The female connector 10 houses the other terminal fittings 12 and comprises a housing 11, whose upper face has the locking arm 20 provided thereon, and the spacer 30, which is inserted into the space below the locking arm 20.

Like the male connector housing 1, the female connector housing 11 is also made in a unified manner from synthetic resin, and, as described above, fits into the hood member 4 of the male connector housing 1. The interior of the female connector housing 11 has terminal housing chambers 13 formed therein, these corresponding to the male terminal housing chambers 3, the same number of female terminal housing chambers 13 being formed as there are male terminal housing chambers 3. A female terminal fitting 12 is retained in each of the terminal housing chambers 13. The posterior side of each terminal housing chamber 13 is formed into a terminal insertion opening 13A that is wide open, the anterior side thereof being formed into a narrow opening constituting a terminal attachment opening 13B into which the male terminal fitting 2 is inserted.

The female terminal fitting 12 is formed by bending an electrically conductive piece of metal, its posterior end having a barrel 14 for clamping an electric wire W, and its anterior end comprising a connecting member 15 that connects with the male terminal fitting 2. The female terminal fitting 12 has the electric wire W clamped by the barrel member 14, and is inserted into the terminal housing chamber 13 via the terminal insertion opening 13A, and is thereby attached to the female connector housing 11.

The locking arm 20 for locking the female connector housing 11 in a fitted state with the male connector housing 1 is formed approximately in the centre of the upper face of the female connector housing 11. This locking arm 20 rises upwards at its anterior end, and in its natural state extends approximately horizontally in a downward direction. Further, a space is formed between the locking arm 20 and the upper face of the female connector housing 11. This space forms a spacer insertion groove 24, first insertion members 32 of the spacer 30, described later, fitting therein. In its natural state, a free end 20A of the locking arm 20 aligns with the posterior face of the female connector housing 11; as a result, in the case where the locking arm 20 bends downwards, the free end 20A of the locking arm 20 is located more to the interior with respect to the opening of the spacer insertion groove 24 (see FIG. 6).

The centre of the locking arm 20 has a protrusion 21 formed thereon, this protrusion 21 fitting as described above with the anterior edge of the fitting groove 5. Further, an operating member 22 is formed towards the posterior end of the upper face of the locking arm 20. This operating member 22 extends in a width-wise direction so as to be somewhat wider than the body of the locking arm 20, its upper face being stepped, which serves to prevent slippage during an operation whereby the locking arm 20 is pushed downwards.

The anterior face of the operating member 22 has a through hole 23 formed in an anterior-posterior direction (the lengthwise direction of the locking arm 20). This through hole 23 is actually a hole formed for forming the protrusion 21 by insert moulding; however, in the present embodiment, it also serves to allow the insertion of a second insertion member 38, described later, of the spacer 30.

Furthermore, the claws 37, described later, of the spacer 30 surround and fit with from below the portions at the anterior end of the operating member 22 that extend from the left and right from the locking arm 20.

The lower face at the free end of the locking arm 20 widens in the posterior direction, and as a result the opening (at the posterior side of the female connector housing 11) of the spacer insertion groove 24 is slightly wider than its width at its inner side (the anterior side of the female connector housing 11). For this reason, in the state where the connector housings 1 and 11 are correctly fitted together, the first insertion members 32 can be inserted easily into the spacer insertion groove 24. At the centre of the spacer insertion groove 24, a spacer guiding member 16 protrudes upwards from the female connector housing 11. This spacer guiding member 16 is provided in a cross-sectionally T-shape in an anterior-posterior direction, that is, in the direction of insertion of the spacer 30. It is inserted in a U-shaped groove 39 of the spacer 30 and fits with the protruding member 35 of the spacer 30, thereby guiding the insertion operation of the spacer 30. Furthermore, when the locking arm 20 is pushed downwards, the lower face of the locking arm 20 has a groove member (not shown) formed so as to prevent contact of the locking arm 20 with the spacer guiding member 16.

Figure 5:
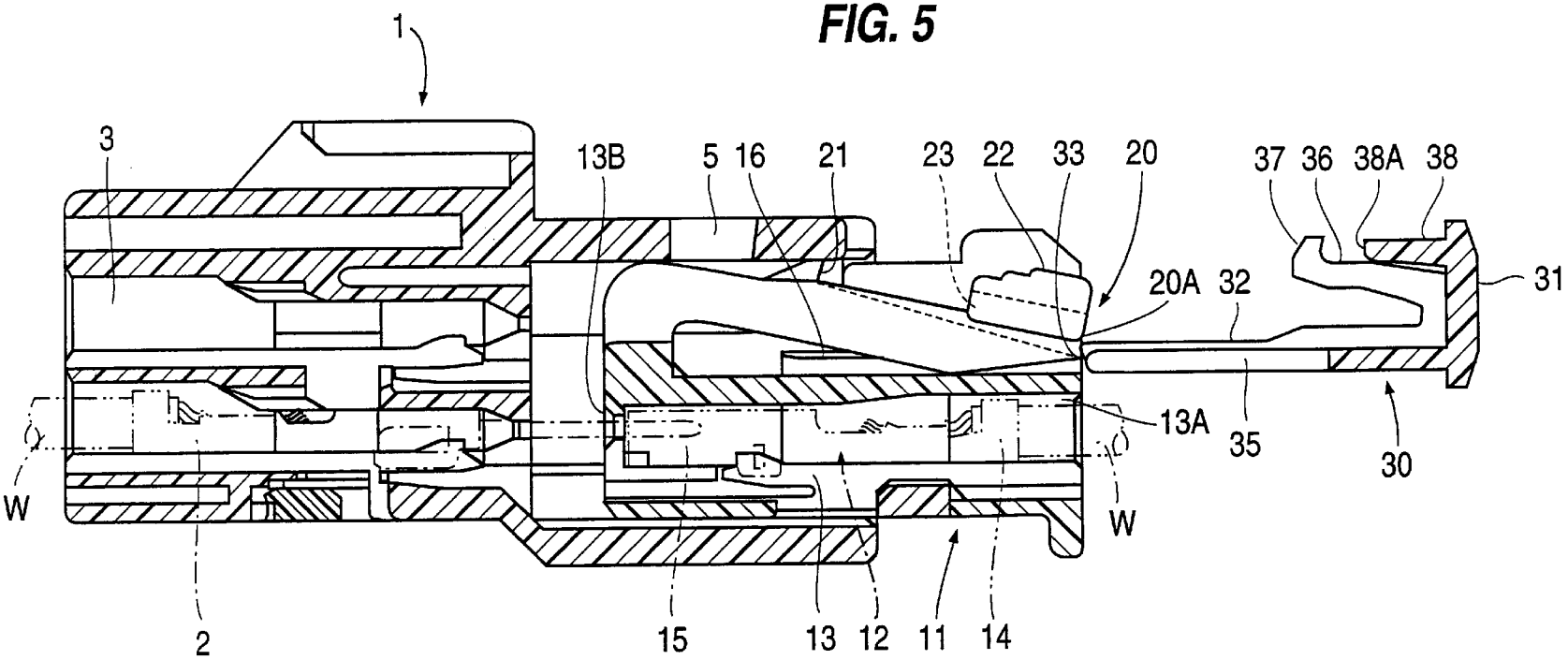
FIG. 5 is a side cross-sectional view showing an attempt to insert the spacer when the connector housing and the corresponding connector housing are in a half-fitted state.

The spacer 30 is formed in a unified manner from synthetic resin, and is insertable into the spacer insertion groove 24 from the posterior end of the female connector housing 11 (see FIG. 5). The posterior end of the spacer 30 has a schematically rectangular shaped base plate 31 provided thereon. A pair of first insertion members 32 protrude in an anterior direction from the lower end of the base plate 31. The anterior ends (insertion ends 33) of the first insertion members 32 are tapered towards the anterior direction so as to facilitate smooth insertion into the spacer insertion groove 24. Moreover, this tapering inclines so as to extend downwards from the anterior ends of the first insertion members 32 towards the lower edge in the posterior direction. Slopes 34 are provided in the middle of the upper faces of the first insertion members 32; thereafter, the insertion members 32 are formed so as to be somewhat elevated. Furthermore, the inner lower edges of both the first insertion members 32 have the protruding members 35 formed thereon, the central portions of these protruding members 35 constituting U-shaped grooves 39 having a U shape extending from the insertion ends 33 towards the base plate 31, the spacer guiding member 16 being insertable therein.

Both the upper side portions of the base plate 31 have a pair of anterior locking members 36 that are bendable upwards and downwards. These locking members 36 are formed half-way along the length of the first insertion members 32, their anterior portions having claws 37 pointing upwards. When the spacer 30 is correctly assembled with the female connector housing 11, these claws 37 surround and fit with the anterior end portions (the portions extending outwards in a width-wise direction) of the operating member 22.

Further, only the central portion of the upper end of the base plate 31 protrudes upwards, and from that point onwards a second insertion member 38 protrudes anteriorly. This protrudes half-way along the length of the locking member 36, and is formed so as to be insertable into the through hole 23 of the locking arm 20. Its anterior end forms an inclined face 38A by tapering the lower face. When the connector housings 1 and 11 are correctly fitted together, that is, when the locking arm 20 has reverted to a position corresponding to this correct fitted position, this second insertion member 36 is arranged to be insertable into the through hole 23.

The operation and effects of the embodiment are as follows:

First, each terminal fitting 2 and 12 is attached to the male and female connector housings 1 and 11, and the male and female connector housings 1 and 11 are made to face each other. Then, the female connector housing 11 is inserted into the hood member 4 of the male connector housing 1. When this is being done, the locking arm 20 bends downwards. Then, once male and female connector housings 1 and 11 reach the correct fitted state, the male and female terminal fittings 2 and 12 are connected correctly. The protrusion 21 fits into the fitting groove 5 and the locking arm 20 changes shape so as to revert to its original unbent state. Accordingly, the protrusion 21 and the fitting groove 5 fit together and the connector housings 1 and 11 are retained together.

Next, the insertion of the spacer 30 into the spacer insertion groove 24 is carried out. As described above, when the connector housings 1 and 11 are in the correct fitted state, the locking arm 20 has reverted to its original unbent shape. As a result, the opening of the spacer insertion groove 24 is in an open state; accordingly, the insertion end 33 of the first insertion members 32 of the spacer 30 are inserted therein. During this insertion operation, to the extend that the U-shaped groove 39 of the spacer 30 is fitted with the spacer guiding member 16 as the insertion proceeds, the protruding members 35 of the spacer 30 are guided by the spacer guiding member 16, resulting in a smooth insertion operation.

As the insertion of the spacer 30 proceeds further, the claws 37 protruding from the anterior end of the locking member 36 pass under the lower face of the operating member 22 by bending, and then revert to their unbent shape and fit with the anterior end of the operating member 22. Simultaneously, the second insertion member 38 is inserted into the through hole 23 of the locking arm 20.

In the manner described above, once the spacer 30 is inserted into the spacer insertion groove 24, the operator can confirm that the connector housings 1 and 11 are correctly fitted together. That is, when the connector housings are correctly fitted together, the locking arm 20 reverts to its unbent shape. Consequently, the opening of the spacer insertion groove 24 is open, and whether the spacer 30 can be inserted or not allows one to detect whether or not the correct fitted state has been achieved.

The above operation is performed in the reverse order for releasing the connector housings 1 and 11.

Next, the half-fitted state of the two connector housings 1 and 11, whereby these are not sufficiently fitted together, is detected as described below.

In this case, the protrusion 21 of the locking arm 20 is in a pressed state against the lower face of the hood member 4. Accordingly, the locking arm 20 is in a state whereby it is bent downwards. For this reason, the opening of the spacer insertion groove 24 is closed. Consequently, the fact that the insertion of the spacer 30 is impossible in general indicates that a half-fitted state obtains.

Figure 6:
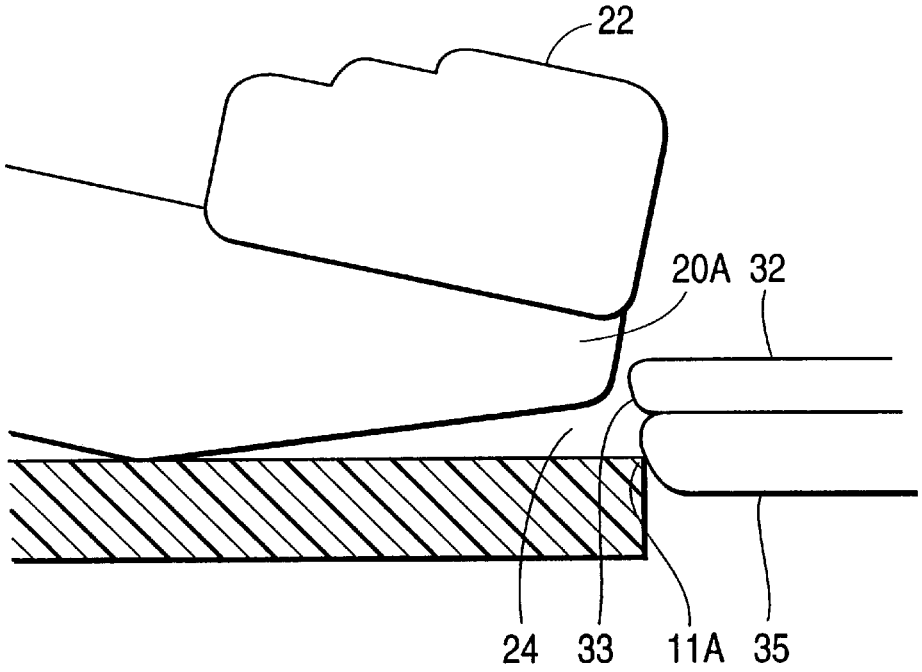
FIG. 6 is a partially enlarged view showing the vicinity of the spacer insertion groove.
Figure 7:
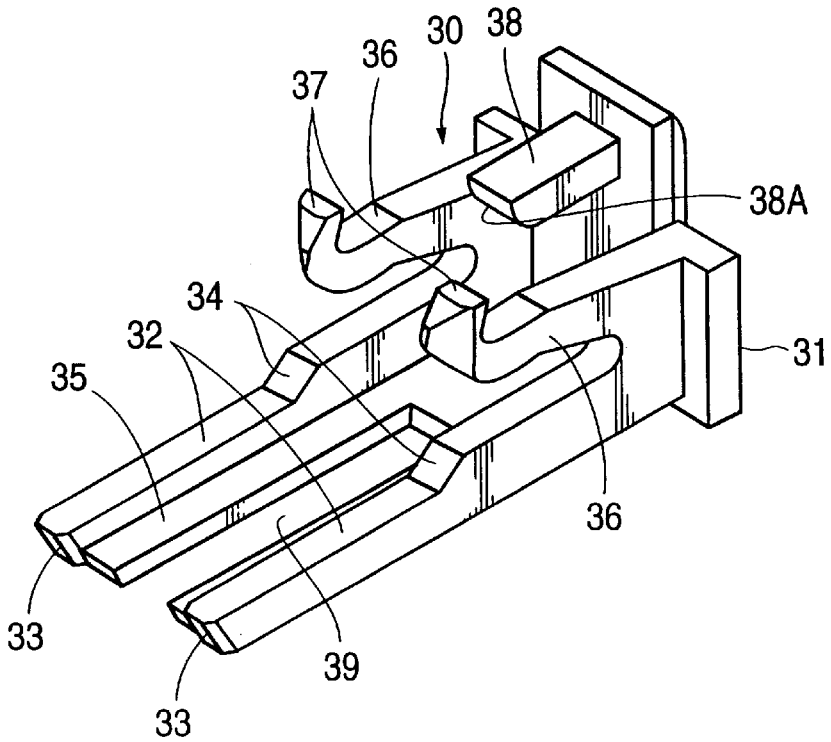
FIG. 7 is a diagonal view showing the spacer.
Figure 8:
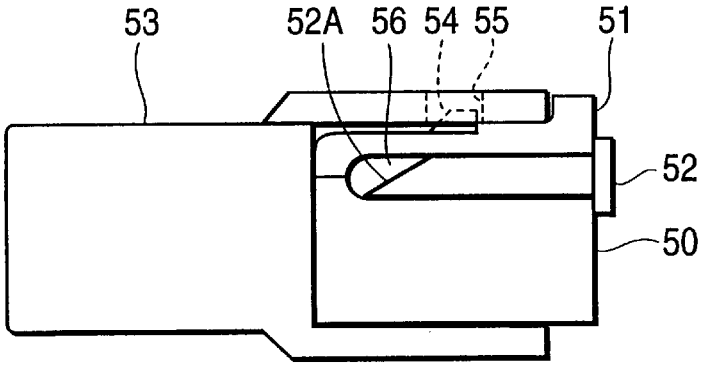
FIG. 8 PRIOR ART
FIG. 8 is a cross-sectional view of a conventional example wherein a spacer is inserted into correctly fitted connector housings.
Figure 9:
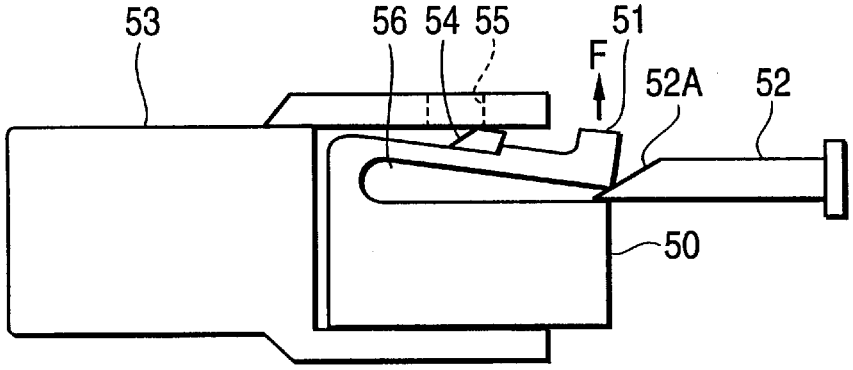
FIG. 9 PRIOR ART
FIG. 9 is a cross-sectional view of the conventional example wherein an attempt is made to insert the spacer into connector housings that are in a half-fitted state.
Figure 10:
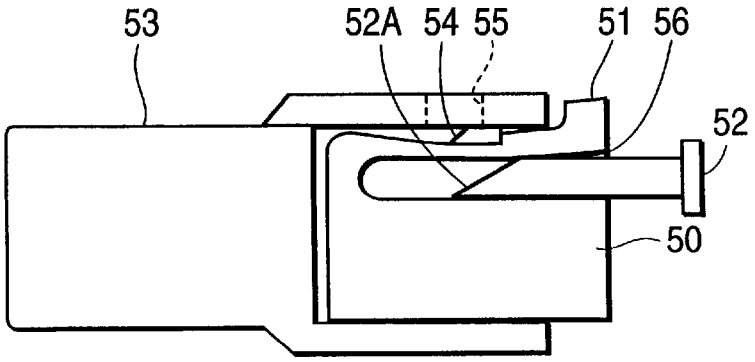
FIG. 10 PRIOR ART
FIG. 10 is a cross-sectional view of the conventional example wherein a spacer is inserted into connector housings that are in a half-fitted state.

However, in a realistic situation, in spite of the fact that the opening of the spacer insertion groove 24 is closed, there is a possibility of an effort being made to forcibly insert the spacer 30 therein (see FIGS. 5 and 6).

As described above, a downward facing taper is provided on the insertion end 33 of the spacer 30. For this reason, even if an attempt is made to insert the first insertion members 32 into the insufficiently open spacer insertion groove 24, unlike in the conventional case, no force is exerted that raises the locking arm 20 upwards along the inclined face of the insertion end 33. Moreover, as shown in FIG. 6, when the locking arm 20 is bent downwards, its free end 20A is further in compared to the posterior edge 11A of the female connector housing 11. Accordingly, even if an attempt is made to insert the first insertion member 32, the insertion end 33 can make contact with the end face of the opening of the spacer insertion groove 24 of the female connector housing 11 more easily than with the free end 20A of the locking arm 20 (see FIG. 6). For this reason, the locking arm 20 cannot be forced open.

The operator, upon discovering that the insertion of the spacer 30 is impossible, concludes that the connector housings 1 and 11 are not in a correct fitted state.

However, in spite of the above configuration, it is not impossible that the spacer 30 is inserted forcibly when the connector housings 1 and 11 are in half-fitted state, resulting in the first insertion members 32 being inserted into the spacer insertion groove 24. Even in such a case, since the thickness of the first insertion members 32 is arranged to be less than that of the spacer insertion groove 24, the locking arm 20 does not return to the correct position. For this reason, the positions of the second insertion member 38 and the through hole 23 do not correspond, making it impossible to fit these together. Thus, even in the unlikely event that the first insertion members 32 of the spacer 30 are inserted into the spacer insertion groove 24 when the connector housings 1 and 11 are in a half-fitted state, the second insertion member 38 cannot enter the through hole 23, making the operator aware of the half-fitted state. Moreover, the anterior end of the second insertion member 38 similarly has a downward tapering face, which makes insertion into the through hole 23 extremely difficult, for the same reason as in the case described above.

In this manner, according to the present embodiment, in the case where the connector housings 1 and 11 are in a correctly fitted state, the first insertion members 32 of the spacer 30 can be inserted easily into the spacer insertion groove 24. On the other hand, in the case of a half-fitted state, since the arrangement is such that the spacer 30 cannot be inserted, the half-fitted state is detected.

Furthermore, in the case of a half-fitted state, even in the unlikely event that the first insertion members 32 protrude into the spacer insertion groove 24, since the second insertion member 38 and the through hole 23 cannot fit together, the reliability of detection of the half-fitted state further increases. A further effect is achieved in that the through hole 23 is formed as a result of the insert moulding process, thereby eliminating the need to alter the existing configuration in order to provide the through hole 23.

The present invention is not limited to the embodiments described above. For example, the possibilities described below also lie within the technical range of the present invention.

(1) An anterior end of a second detecting means can be tapered in a direction opposite to a direction of bending of a locking arm. In such a case, since the anterior end of the second detecting means also has a tapered face that is tapered in a direction opposite to the direction of bending of the locking arm, when the connector housings are in the correct fitted state, due to the anterior end being narrow, the insertion of the second detecting means into the through hole can be carried out easily and in the half-fitted state this insertion can be controlled.

(2) Although in the present embodiment, the male connector housing has a covering member, and the female connector housing fits therein, this arrangement can, of course, be reversed.

I claim:

1. A connector having a housing, a bendable, cantilever locking arm on the housing having a free end, and a space between the locking arm and the housing having an open end at the free end of the locking arm, the locking arm being bent towards the housing to narrow said space during connection with a mating connector and resuming an unbent condition on full engagement of the connectors, and a spacer with an insertion member insertable through said open end and into said space said insertion member and said space having about the same height when the locking arm is unbent so that said spacer is insertable in said space only when said locking arm is in the unbent condition, wherein a distal end of said spacer insertion member constitutes primary detecting means for indicating a half-fitting of the connectors and is tapered away from said housing on the side opposite to said locking arm.

2. A connector according to claim 1 wherein in the bent condition, a spacer engaging portion of said locking arm is inboard a spacer engaging portion of said housing.

3. A connector according to claim 1 wherein said spacer further includes secondary detecting means engageable with said locking arm only in the unbent condition thereof.

4. A connector according to claim 2 wherein said spacer further includes secondary detecting means engageable with said locking arm only in the unbent condition thereof.

5. A connector according to claim 3 wherein said secondary detecting means comprise a projection of said spacer and a corresponding aperture of said locking arm.

6. A connector according to claim 4 wherein said secondary detecting means comprise a projection of said spacer and a corresponding aperture of said locking arm.

7. A connector according to claim 5 wherein the tip of said projection is tapered in the same direction as the distal end of said spacer.

8. A connector according to claim 6, wherein the tip of said projection is tapered in the same direction as the distal end of said spacer.

9. A connector according to claim 5 wherein said locking arm includes a protrusion for engagement in a recess of a mating connector, said aperture being produced during insert moulding of said locking arm.

10. A connector according to claim 7, wherein said locking arm includes a protrusion for engagement in a recess of a mating connector, said aperture being produced during insert moulding of said locking arm.

11. A connector according to claim 1 wherein said distal end of the spacer is of greater width than said locking arm.

12. A connector according to claim 11 wherein said spacer has two spaced limbs.

13. A connector according to claim 12 wherein said housing further includes guiding means for engagement between said limbs so as to ensure insertion of said spacer along a pre-defined axis.

14. A connector according to claim 1 wherein said spacer further includes retention members for snap-fitting engagement with said locking arm.

* * * * *